US005931270A

United States Patent [19]

Mitchell

[11] Patent Number: 5,931,270

[45] Date of Patent: Aug. 3, 1999

[54] BRIEFCASE HANDLE AND STRAP SUPPORTS

[76] Inventor: Jerry Mitchell, 226 N. Water St., Milwaukee, Wis. 53202

[21] Appl. No.: 08/934,368

[22] Filed: Sep. 19, 1997

[51] Int. Cl.[6] ..... A45C 13/32; A45C 13/28; A45C 13/30

[52] U.S. Cl. ..... 190/115; 190/116; 190/902; 150/108; 224/901.8

[58] Field of Search ..... 190/115, 116, 190/902, 39; 224/901.8; 150/108

[56] References Cited

U.S. PATENT DOCUMENTS

| | | | |
|---|---|---|---|
| 882,601 | 3/1908 | White | 190/115 |
| 1,376,529 | 5/1921 | Grant | 190/115 |
| 1,638,753 | 8/1927 | Stein et al. | 190/115 |
| 2,960,137 | 11/1960 | Lipsitz | 150/108 X |
| 4,239,074 | 12/1980 | Kahn | 190/115 |
| 4,261,448 | 4/1981 | Myers et al. | 190/115 |
| 4,424,841 | 1/1984 | Smith | 190/116 X |
| 4,548,375 | 10/1985 | Moss | 224/901.8 X |
| 4,733,809 | 3/1988 | Pursell | 224/901.8 X |
| 4,907,633 | 3/1990 | Eckstein | 190/116 X |
| 4,919,240 | 4/1990 | Tobias | 190/116 X |
| 4,978,044 | 12/1990 | Silver | 150/108 X |
| 5,119,910 | 6/1992 | Heggeland | 190/116 |
| 5,127,500 | 7/1992 | Mitchell | 190/115 |

*Primary Examiner*—Sue A. Weaver
*Attorney, Agent, or Firm*—Michael Best & Friedrich LLP

[57] ABSTRACT

A briefcase includes a body portion defining a receptacle and having an open top, a flap formed of a pliable material and extending over the open top for closing the same, a handle and an anchoring means at each end of the handle for securing the handle to the flap. A backup plate is mounted in the flap and extends over substantially the entire area thereof and is formed of a metallic material which is relatively stiffer than the material forming the flap. A sheath covers each end of the backup plate and is disposed between the backup plate and the flap to protect the flap from wear. Strap anchors are disposed at each end of the body portion and are formed of a pliable material. Each strap anchor includes an upper leaf portion attached to the body portion and a lower leaf portion folded back under the upper leaf portion. Hook and nap fastening material are disposed on the contacting surfaces of the upper and lower leaf portions respectively.

5 Claims, 2 Drawing Sheets

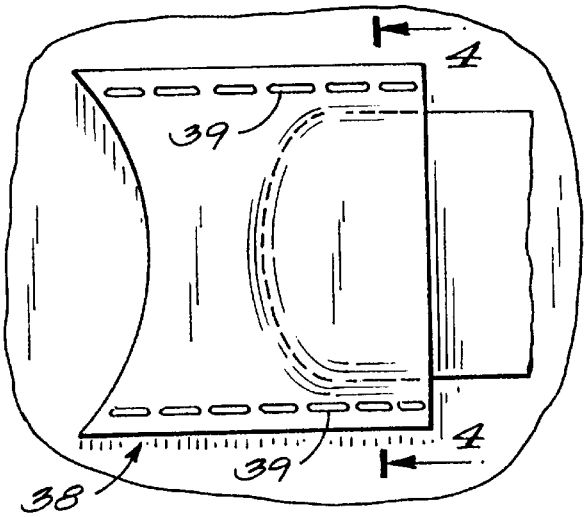
Fig. 3
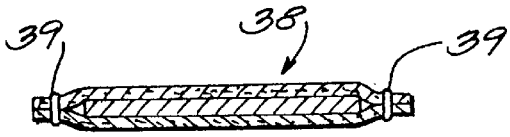
Fig. 4
Fig. 5
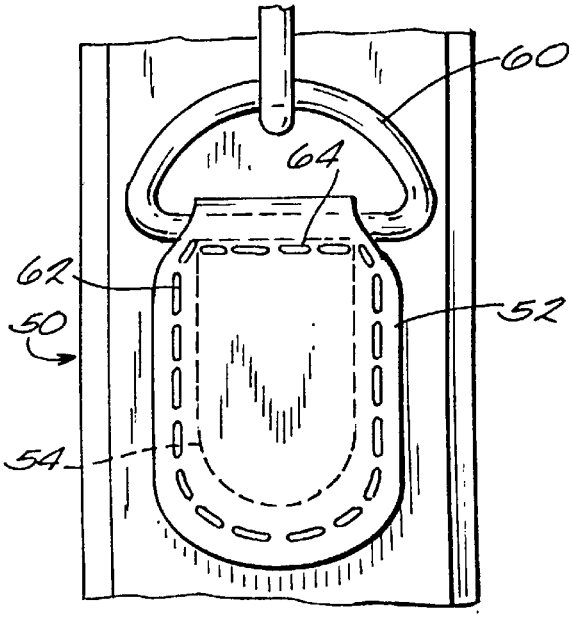
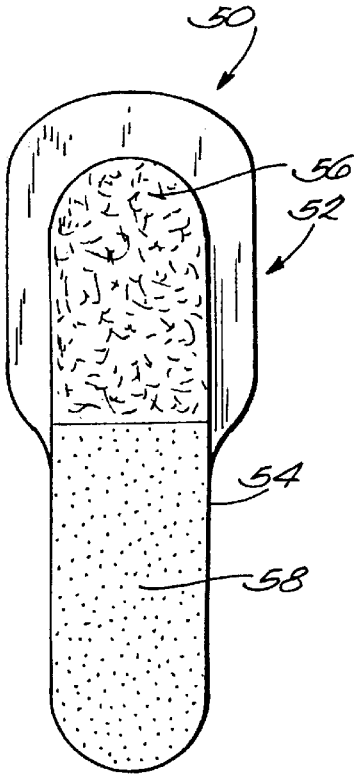
Fig. 6

BRIEFCASE HANDLE AND STRAP SUPPORTS

BACKGROUND OF THE INVENTION

This invention relates to luggage and more particularly to a handle support assembly and strap anchors for luggage.

As used herein, the term luggage means briefcases, sample cases, purses, suitcases, garment bags and any other item for carrying articles and which is supported by a handle and/or strap.

Luggage, items as defined above, are commonly formed of a relatively pliable material such as leather, vinyl, fabric and the like. Such luggage often includes a handle attached to a closure flap or top by rivets. When the luggage contains heavy objects and is being supported by its handle, the weight is concentrated in the handle anchors. In addition, such luggage often includes a carrying strap attached by means of anchors which are sewn or riveted to the body of the luggage. When the case contains heavy objects and is being supported by its handle or the strap anchors, a substantial strain is placed on the handle or strap anchors.

SUMMARY OF THE INVENTION

It is an object of the invention to provide a new and improved handle assembly for luggage.

A further object of the invention is to provide a new and improved luggage strap anchor for luggage.

These and other objects and advantages of the present invention will become more apparent from the detailed description thereof taken with the accompanying drawings.

In general terms, the invention comprises luggage including a body portion defining a receptacle and having a closure portion. Strap anchors are provided at each end of the body portion and each includes an upper leaf portion attached to the body portion and a lower leaf portion folded back under the upper leaf portion and hook and nap fastening material disposed on the contacting surfaces of the upper and lower leaf portions to absorb the stress of a heavy load.

According to another embodiment, the luggage includes a handle, anchoring means at each end of the handle for securing the handle to the luggage, a backup plate mounted beneath the surface of the luggage and extending therein over a substantial area thereof, the backup plate being relatively stiffer than the material forming the luggage and a sheath disposed between each end of the backup plate and the luggage material.

BRIEF DESCRIPTION OF THE DRAWINGS

FIG. 3 is a fragmentary view showing a portion of the handle support illustrated in FIG. 2;

FIG. 4 is a view taken along lines 4—4 of FIG. 3;

FIG. 5 shows the strap anchor for the luggage of FIG. 1; and

FIG. 6 shows the strap anchor of FIG. 5 in greater detail.

DETAILED DESCRIPTION OF THE PREFERRED EMBODIMENT

Figure 1:
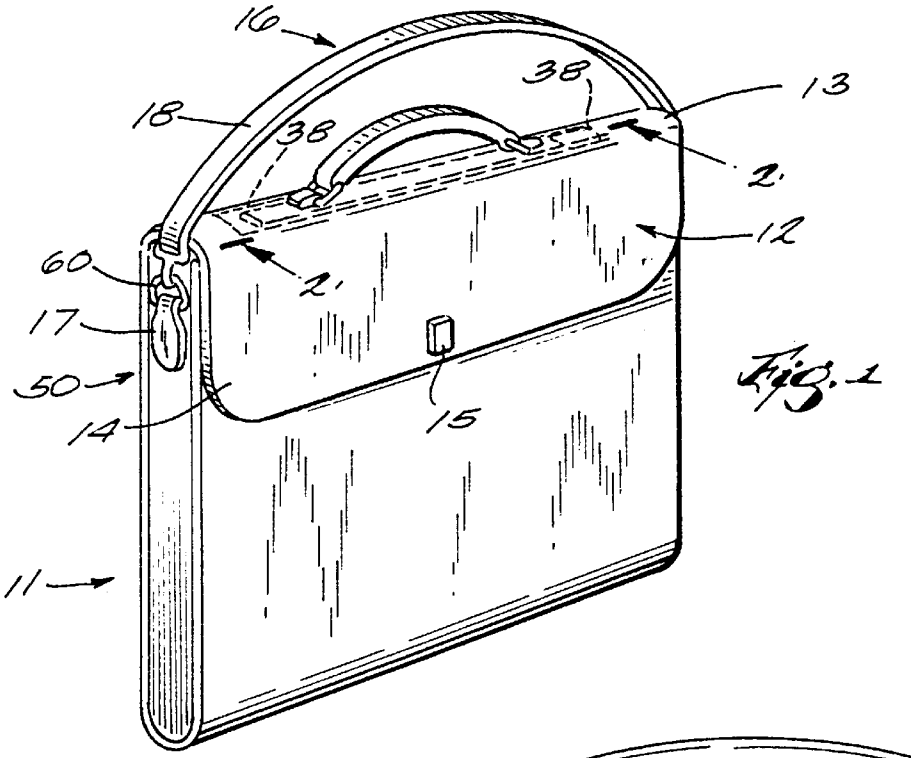
FIG. 1 is a perspective view showing the article of luggage incorporating the present invention.

FIG. 1 shows an article of luggage 10 having a strap anchor and handle anchor according to the invention. While the article of luggage in FIG. 1 comprises an envelope-type briefcase, it is to be understood that the term luggage as used herein also includes purses, suitcases, garment bags and other luggage items.

The article of luggage or briefcase 10 is an envelope-type body 11 and a closure flap 12. The flap 12 includes a top portion 13 which extends across the open upper end of the body 11 on the side portion 14 which extends downwardly across the front of the body 11. The latch 15 or other securing device, such as one or more straps (not shown), are provided at the lower end of the flap 12 for securing the same in a closed position. A handle assembly 16 is mounted on the upper portion 13 of the flap 12 for supporting the case 10 and its contents. In addition, a strap anchor 17 is attached at each end of the body 11 for securing a strap 18 to the case 10.

Figure 2:
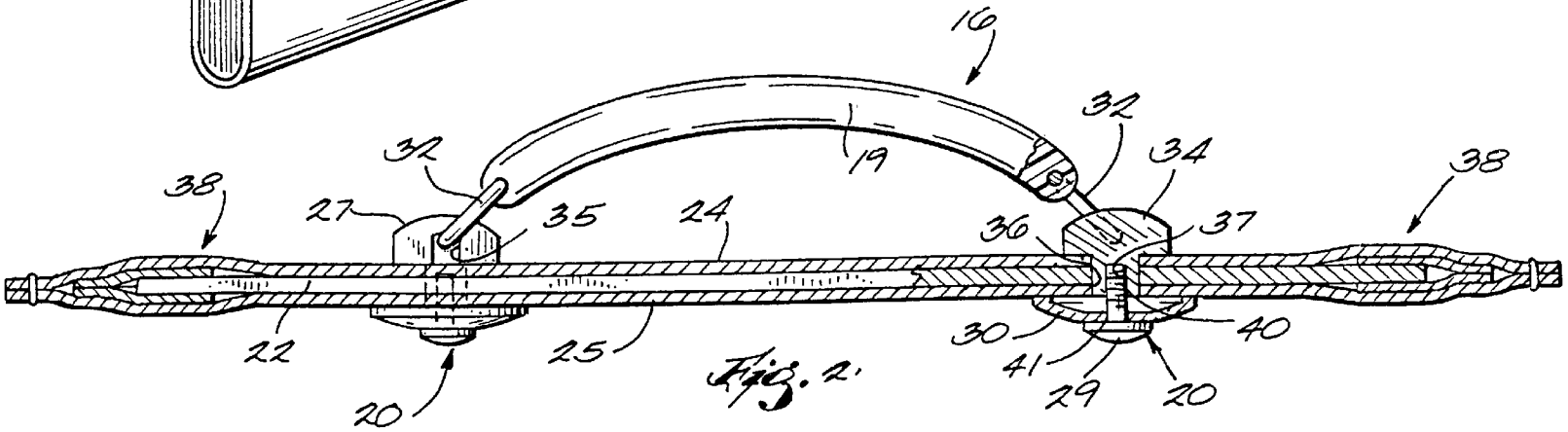
FIG. 2 is an enlarged, fragmentary view, with parts broken away, illustrating the handle assembly of the luggage of FIG. 1 in greater detail.

The handle assembly 16 includes a handle 19, anchoring assemblies 20 and a metallic support strip 22. As seen in FIGS. 1 and 2, the metallic support strip 22 is disposed between the upper and lower layers of leather or other pliable material 24 and 25 from which the flap 12 is formed. The strip extends substantially from one end of the flap to the other and has a width slightly smaller than that of the top portion 13. The strip may have some resiliency, but preferable is formed of a relatively stiff material, such as steel.

The anchor assemblies 20 are identical, and each includes an anchor member 27, a screw 29, a dished washer 30 and a D-ring 32. Each anchor member 27 includes a body portion 34 having a recess 35 formed in each of its sides and a stem 36 extending downwardly from the body portion 34 and having an internally threaded bore 37. A sheath 38 is disposed over each end of the strip 22 to shield the material 24 and 25 forming the flap 12. The sheath 38 comprises two identical pieces of leather, vinyl or similar pliable material sewn together along their lateral sides at 39 to define an open ended pocket for receiving the ends of strip 22. The sheath 38 is sewn between the layers 24 and 25 of the flap during assembly.

When a person carries the briefcase 10 while walking, the case tends to move up and down with each step. This causes the strip 22 to flex so that the ends of the strip move relative to the material forming the flap 14. The sheath 38 opens and closes with movement of the strip 22 to shield the flap material from abrasion. On the other hand, the opening and closing action of the sheath 38 minimizes abrasion of the sheath itself.

In assembly, the strip 22 having a sheath 38 at each end is placed between the material 24 and 25 before they are joined to form the flap 12. The D-rings 32 are passed through the openings in the ends of handle 18 and their ends are received within the recesses 35 as shown in FIG. 2. The stems 36 are then passed downwardly through aligned openings in the material 24 and 25, opening 40 in the strip 22 and the center opening 41 and the washer 30. The screw 29 is then threaded into the bore 37 and tightened to secure the handle 18 in position on flap 14.

The strip 22 distributes the weight of the case 10 and its contents over the entire area of the flap top portion 13. As a result, the stress is not localized in the area where the handle 18 is secured so that there is no sag or deformity of the flap 14 when the case is full and is supported by the handle 18. Furthermore, if the handle assembly should become damaged, it can easily be repair or replaced by removing the screws 29.

The strap anchor 17 is shown more particularly in FIGS. 5 and 6 to comprise and elongate strip 50 having an upper portion 52 and a lower portion 54 which has a reduced width relative to the upper portion 52. The center of the upper portion 52 is covered by a nap material 56 of a hook and nap fastener, such as that sold under the trademark VELCRO, and the entire lower portion 54 is covered by the hook material 58, although it would be appreciated that this may be reversed with the hook material 58 being on the lower portion 54 and the nap material 56 being on the upper portion 52. A D-ring 60 is placed at the junction of the upper and lower portions 52 and 54 and the portions are folded toward each other to bring the hook and nap materials 56 and 58 together. The upper portion is then sewn to the case 10 at 62 and the upper and lower portions are sewn together below the D-ring at 64.

It can be seen that the hook portion 58 extends beyond the junction of the upper and lower portions 52 and 54. As a result, when the strap anchor 17 is folded as shown in FIG. 5, a portion of the material comprising the hook portion is positioned between the strap anchor 17 and the D-ring 60. This provides reinforcement for the leather material forming the anchor 17.

While the hook and nap materials 56 and 58 are relatively easy to separate in a direction perpendicular to their surfaces, separation in a direction parallel to their surfaces is substantially more difficult because as each hook tends to separate from one loop of the nap, it will immediately re-engage another loop. This characteristic is utilized in the strap anchor 17 so that the hook and nap material take up the stress of the strap 18 and reduce the stress on the stitches 62 and 64. This substantially lengthens the life of the strap anchors.

While only a few embodiments of the invention have been illustrated and described, it is not intended to be limited thereby but only by the scope of the appended claims.

I claim:

1. An article of luggage including a body portion defining a receptacle, a pair of strap anchors secured to said article of luggage for being engaged by opposite ends of a support strap, each strap anchor including an upper portion attached to the case and a lower portion folded back under the upper portion and disposed between the upper portion and the case, hook and nap fastening material disposed on the contacting surfaces of the upper and lower portions for mutual engagement, each of said strap anchors being secured to the article of luggage in surrounding relation to the hook and nap fastening material, whereby the stress of the strap is absorbed by the hook and nap fastener.

2. The article of luggage set forth in claim 1 wherein each said strap anchors a piece of flat, pliable material, the upper portion having a length and width greater than that of the lower portion, said upper portion being stitched to said body portion in surrounding relation to the lower portion.

3. An article of luggage including a body portion defining a receptacle and a closure portion, a handle, anchoring means at each end of said handle for securing said handle to said closure portion, said article of luggage being formed by a pliable material, upper and lower layers of said material forming said closure portion, a support strip mounted between the layers of material forming said closure portion and extending therein over a substantial area thereof, said support strip comprising a relatively stiff metallic member and having opposite ends, said anchoring means including fastening means extending through said closure portion and said support strip for fastening said handle to said support strip for supporting said article of luggage, and a sheath disposed between said layers and over each end of said support strip, said sheaths being separate and distinct from said layers said sheaths each comprising a pair of pliable members attached at their opposite sides and free to separate at center portions as said support strip flexes in use to shield the layers of pliable material from the ends of the support strip relative to said layers to prevent the ends of said support strip from abrading the material forming the closure portion.

4. The article of luggage set forth in claim 3 wherein said sheaths comprise a pair of identical flat members of a pliable material joined at their edges and open at their ends.

5. The article set forth in claim 4 and including a pair of strap anchors secured to said article of luggage for being engaged by opposite ends of a support strap, each strap anchor including an upper portion attached to the case and a lower portion folded back under the upper portion and disposed between the upper portion and the case, hook and nap fastening material disposed on the contacting surfaces of the upper and lower portions for mutual engagement, each of said strap anchors being secured to the article of luggage in surrounding relation to the hook and nap fastening means, whereby the stress of the strap is absorbed by the hook and nap fastener.

* * * * *